US005784863A

United States Patent [19]

Davis

[11] Patent Number: 5,784,863

[45] Date of Patent: Jul. 28, 1998

[54] SANITARY FILL TUBE AND ROTARY VALVE ASSEMBLY FOR A POUCH PACKAGING MACHINE

[75] Inventor: Steven D. Davis, Yuciapa, Calif.

[73] Assignee: Winpak Lane, Inc., San Bernardino, Calif.

[21] Appl. No.: 867,499

[22] Filed: Jun. 2, 1997

[51] Int. Cl.[6] ..... B65B 9/12

[52] U.S. Cl. ..... 53/551; 53/554; 53/202

[58] Field of Search ..... 222/367, 139, 222/370; 53/550, 551, 552, 554, 553, 503, 202, 493; 141/344, 345, 301, 236, 302, 10, 286

[56] References Cited

U.S. PATENT DOCUMENTS

| | | | |
|---|---|---|---|
| 89,569 | 5/1869 | Fanyon | 141/145 |
| 1,090,607 | 3/1914 | Fritz | 141/345 |
| 2,889,671 | 6/1959 | Weisman | 53/554 |
| 3,729,034 | 4/1973 | Farrell | 141/332 |
| 4,081,004 | 3/1978 | Harris | 141/10 |
| 4,769,974 | 9/1988 | Davis | 53/554 |
| 5,097,993 | 3/1992 | Davis | 222/509 |

*Primary Examiner*—John Sipos
*Assistant Examiner*—James P Calve
*Attorney, Agent, or Firm*—James G. O'Neill

[57] ABSTRACT

A sanitary fill tube assembly includes a pair of large diameter fill tubes connected to a spreader having a rotary valve system mounted therein. The rotary valve system is actuated by pairs of actuator arms guided through openings in a manifold connected to the fill tubes to precisely move the rotary valve between open and closed position. The rotary valve includes elongated openings therein which are closely matched with and connected to the same size and shape passageways and discharge openings in the spreader so as to more accurately control and meter material being fed into a pouch, and to maintain the overall assembly in a sanitary condition.

19 Claims, 2 Drawing Sheets

SANITARY FILL TUBE AND ROTARY VALVE ASSEMBLY FOR A POUCH PACKAGING MACHINE

BACKGROUND OF THE INVENTION

1. Field of the Invention

This invention relates generally to fill tubes for use in pouch packaging machines, and more particularly, to a fill tube and rotary valve assembly for more accurately controlling the flow and dispensing of viscous material through and from the fill tube, in a sanitary manner.

2. Description of Related Art

Because of technical advances in pouch forming and filling machines, more and more food and other viscous products can be dispensed in product pouches as opposed to cans and bottles. Certain products, however, are very difficult to package in pouches, and/or must be treated very carefully to maintain sanitary conditions and prevent contamination.

The fill tubes, in most prior pouch packaging machines, are nothing more than a hollow tube which may be formed so as to take the shape of a pouch to be filled. Other fill tubes may be comprised of circular or oval tubes having a plunger rod with a bulbous valve at the end thereof, for the control of the velocity of discharge of product from the fill tube. One such prior art fill tube and plunger rod assembly for a pouch packaging machine is shown in U.S. Pat. No. 5,097,993 to W. A. Lane, Inc., the predecessor in interest of Winpak Lane, Inc., the assignee of the present invention.

It has been particularly difficult to package products having particulate matter therein, for instance, cheese, in a sanitary manner. The known fill tubes must be constantly cleaned, and after sustained use, replaced. Additionally, because some products have large pieces of solid product in them which must be placed in large pouches, large fill tubes must be used. This normally prevents the use of circular and/or open-end fill tubes. To overcome the problem of dispensing products, such as cheese, in prior art devices, the discharge end of the fill tube is provided with a head having a plurality of small orifices formed therein. However, the small orifices do not always work correctly and tend to become blocked or clogged, thus causing pouch filling and sanitary problems. Therefore, there exists a need in the art for an improved sanitary fill tube and control valve means for a pouch packaging machine.

SUMMARY OF THE INVENTION

Accordingly, it is a general object of the present invention to provide an improved filling means for a pouch packaging machine. It is a particular object of the present invention to provide an improved fill tube and control valve arrangement for a pouch packaging machine. It is a still more particular object of the present invention to provide an improved fill tube assembly having a plurality of substantially circular fill tubes controlled by a single valve means. It is yet another more particular object of the present invention to more accurately control the flow of viscous material from a pair of fill tubes into a pouch. It is a further particular object of the present invention to provide an improved rotary valve mechanism for use with a plurality of fill tubes to control the flow of a viscous material into a pouch being formed in a pouch packaging machine.

In accordance with one aspect of the invention, there is provided at least one substantially circular fill tube having a rotary control valve mechanism at the discharge end thereof.

The rotary control valve mechanism is held in an opening in a spreader means at the discharge end of the fill tube. The rotary control valve mechanism has at least one opening therein, for alignment with at least one fill tube.

In a preferred embodiment of the invention, there are two fill tubes and the rotary valve assembly is a cylinder having a pair of elongated, elliptical passageways formed therethrough, for alignment with the two fill tubes, and means at each end of the cylinder connected to push rods, which push and/or pull rods rotate the rotary valve assembly between open and closed positions.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 5:
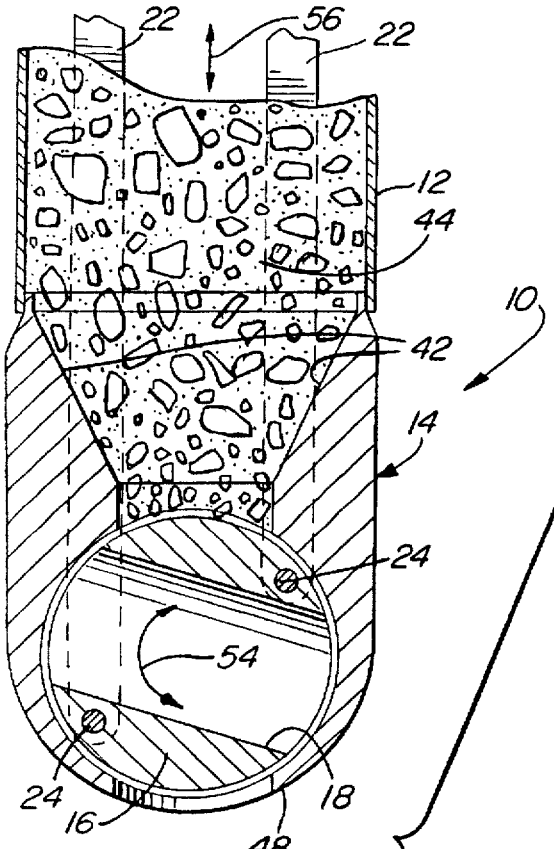
FIG. 5 is a sectional view, similar to that of FIG. 4, showing the rotary valve turned to a closed position, with viscous material held in the fill tube, above the rotary valve.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an explanation of a sanitary fill tube and control valve assembly for use in a pouch packaging machine for filling packages with a viscous material, such as cheese.

Fill tube and plunger rod assemblies for form, fill and seal pouch packaging machines are well known. One such fill tube assembly having a plunger rod assembly therein is set forth in U.S. Pat. No. 5,097,993 which is assigned to the assignee of this invention. The disclosure of this patent is herein incorporated by reference with respect to the features of form, fill and seal pouch packaging machines and the actuating mechanism for the plunger rod assembly and fill tube.

Normally, in form, fill and seal pouch packaging machines, sheets of plastic are fed to a station where they have side seals and a bottom cross seal formed therein. Product is then discharged into the partially formed pouch by means of a fill head or fill tube. The machine is then indexed, and a top seal formed to seal the pouch and the pouch is cut off, to complete the cycle. The machine is then cycled to form further pouches. A plurality of side by side pouches may be formed in such form, fill and seal packaging machines, in a manner well known to those skilled in the art.

The present invention is directed to large fill tubes and a control valve having a rotor cut off therein, for use in form, fill and seal pouch packaging machines. For clarity of understanding, only a double fill tube assembly, including a spreader and a rotating rotor cut off system, is shown on the drawings and described herein.

Turning now to the drawings, there shown is a fill tube assembly 10 including a pair of large diameter fill tubes 12, for example, 3" outside diameter seamless stainless steel tubes having a wall thickness of approximately 0.065 inches. Each of the fill tubes 12 has its lower end sealing secured in or to a pouch spreader 14. A pouch is formed around the spreader 14, in a manner well known to those skilled in the art. A substantially cylindrical valve means or rotor 16, having a pair of elongated or oval openings or passageways 18 extending therethrough, is rotatably held in the spreader 14. The rotor 16 also includes a pair of offset apertures 20 extending therethrough, along the length thereof between ends 30. A pair of actuator rods 22 are secured to each end 30 by means of elongated rods 24, which may be threaded at both ends, inserted in and extending entirely through the apertures 20, so as to protrude beyond each end 30. The actuator rods 22 are then secured to opposite ends 30 of the valve rotor 16 by means of the elongated rods 24 and holding means, such as nuts and washers 26. For example, the threaded ends of the rods 24 may extend through openings 28 formed in the lower end of each actuator rod 22, and be secured by the nuts 26 to each end 30.

The cylindrical valve rotor 16 is easily and quickly inserted in and held in an opening 32 formed perpendicular to the fill tubes 12, extending across spreader assembly 14. The rotor 16 is preferably provided with a pair of O-ring seals 34 held in cavities 36 formed on opposite ends of the rotor to sealingly hold the rotor in opening 32. The spreader 14 may include a pair of outer ears of wings 35 for securing the fill tube and valve assembly in a desired position in a form, fill and seal packaging machine.

The other or upper ends of the fill tubes 12 are sealingly secured to a fill tube plate or manifold 38. This manifold or plate 38 has a pair of circular apertures 40 therein, aligned with the circular interior of each fill tube 12. Plate 38 is in turn, connected to a hopper or reservoir, a feed pump system, and other conduits and tubes, as needed, to enable viscous product to be introduced into the fill tubes 12 through the openings 40.

As shown more clearly in FIGS. 2–5, the pouch spreader assembly 14 includes an outer skirt 37 to shape the pouch being filled, and a plurality of inner passageways 41 having slanted or slopped walls 42, to form substantially funnel shaped openings. The circular interior of the fill tubes 12 is connected to the passageways 41 in spreader 14 which direct viscous food product 44 (see FIG. 5), against sloped walls 42, and down toward smaller, elongated apertures 46, formed adjacent the rotor 16. These elongated apertures 46 are aligned with, and are preferably the same size and shape as the oval passageways 18 formed through the rotor 16. Additionally, a lower or end wall 48 of the spreader 14 includes a pair of discharge or exit apertures 50, also preferably aligned with and the same size and shape as the oval passageways 18, to allow viscous product to be discharged from the spreader 14 into a partially formed pouch around the spreader (not shown). This system allows a pouch around the spreader to be filled with a predetermined amount of product.

Figure 2:
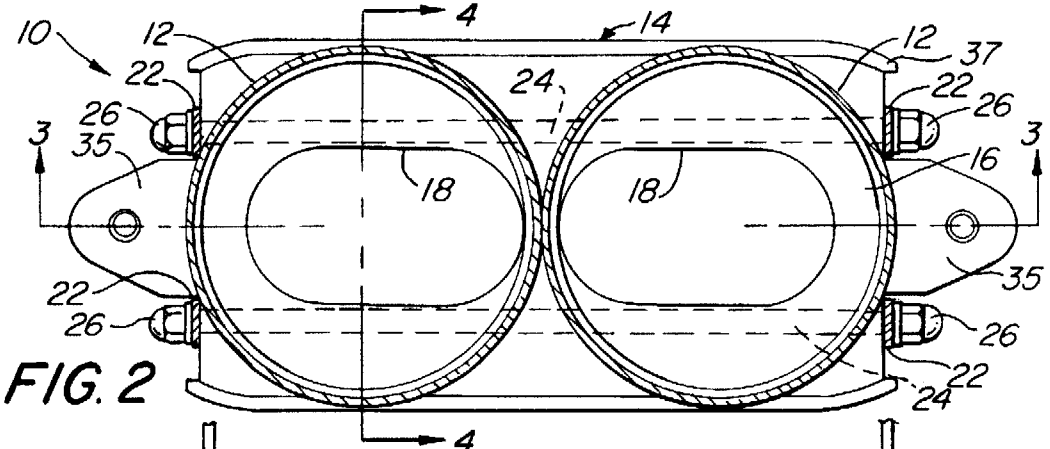
FIG. 2 is a sectional view taken along line 2—2 of FIG. 1.
Figure 3:
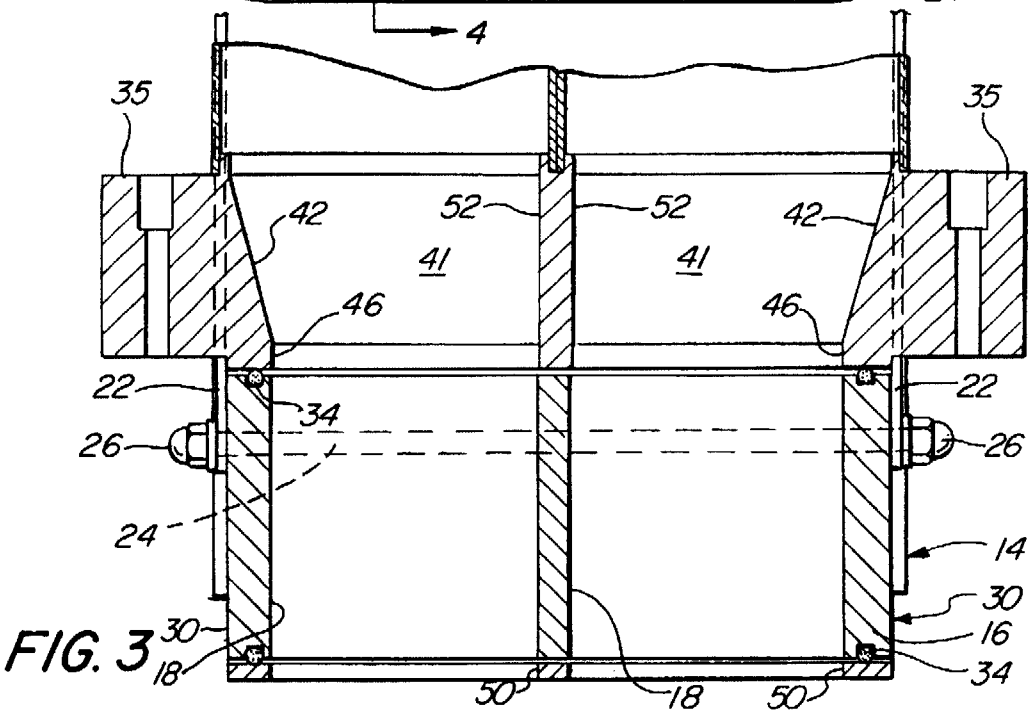
FIG. 3 is a sectional view taken along line 3—3 of FIG. 2.
Figure 4:
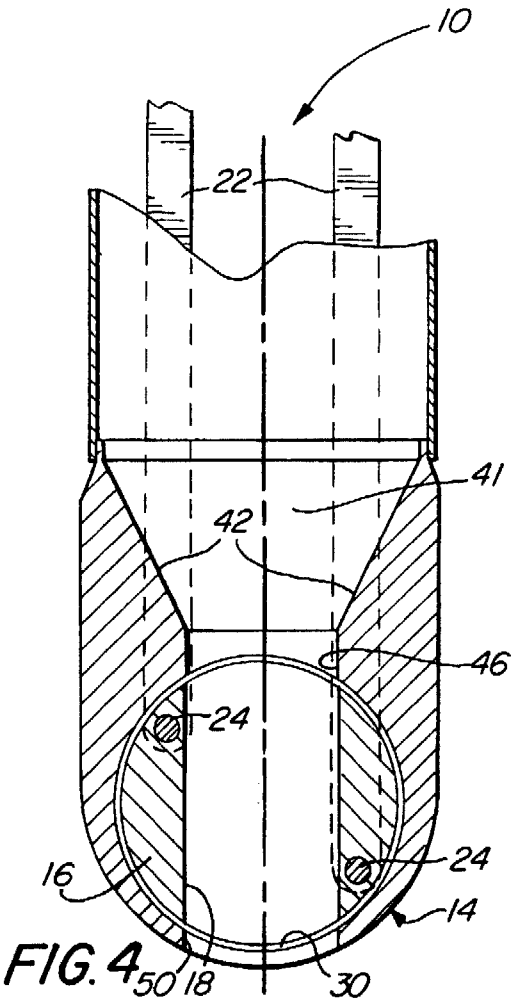
FIG. 4 is a sectional view taken along line 4—4 of FIG. 2.

As best shown in FIGS. 2 and 3, in addition to the internal slanted walls 42, the passageways 41 in the upper portion of the spreader 14 include substantially straight inner walls 52, toward the central portion of the spreader. These inner walls 52 allow the elongated openings 18 and mating oval apertures 46 to be offset, toward the center of the spreader, where they are aligned with an inner wall of each of the fill tubes 12, to more accurately and precisely control the flow of viscous product from the fill tubes 12 through the openings 41, aligned oval openings 18 and out through the oval discharge openings 50, to fill a pouch.

Figure 1:
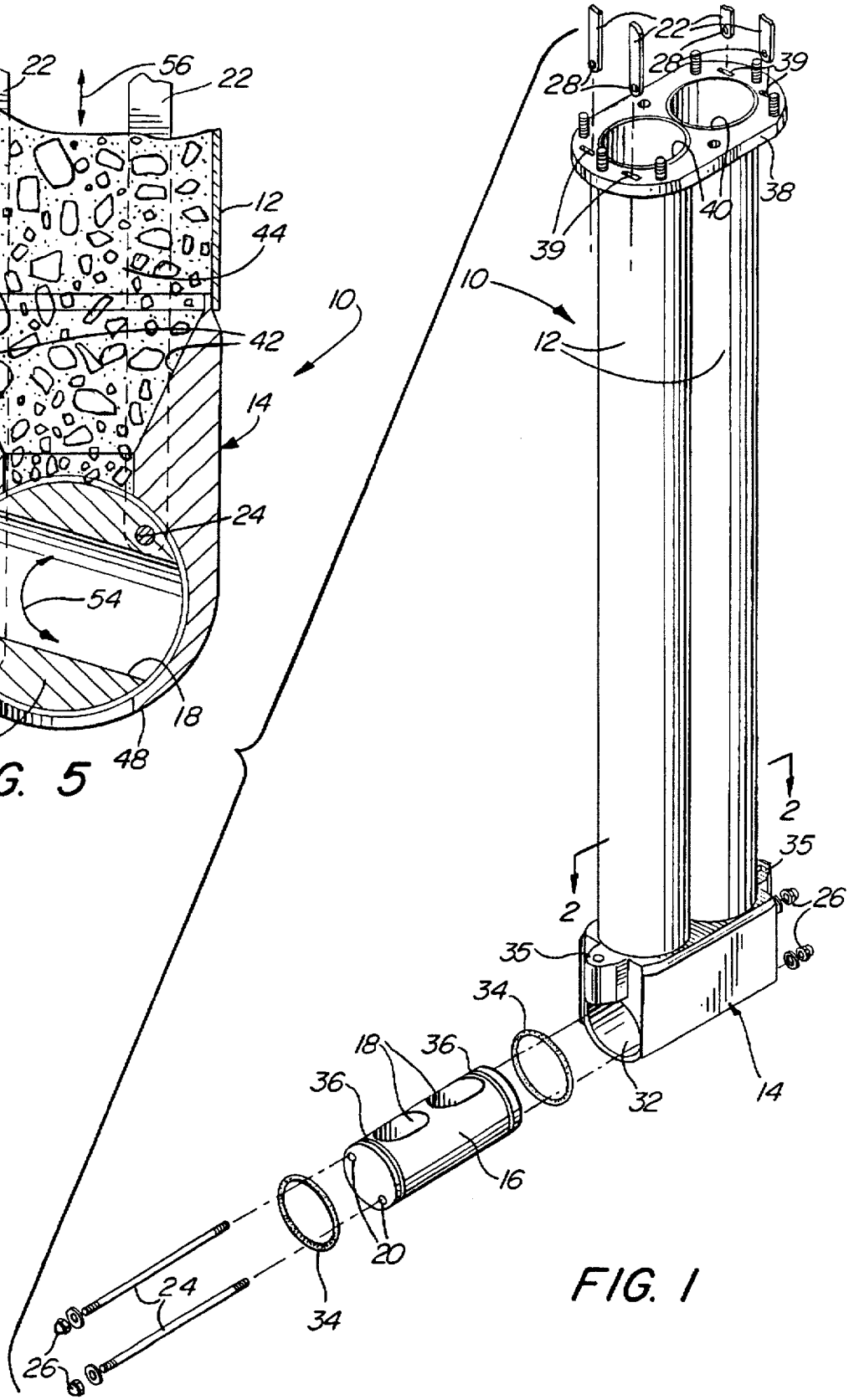
FIG. 1 is an exploded perspective view of a preferred embodiment of a fill tube and rotary valve assembly of the present invention.

As best shown in FIG. 1, the actuator rods 22 are inserted into and guided by a pair of slots 39 formed in plate 38. The outer ends of the actuator rods 22 are connected to and reciprocated by a hydraulic, pneumatic, or mechanical drive system, such as a reciprocating shaft and hub assembly means (not shown). Such a drive system would reciprocate the rods 22, to partially turn the rotor valve 16, in the direction of arrow 54 (see FIG. 5) between the fully open position (FIGS. 2 through 4) and the fully closed position (FIG. 5). That is, with the actuator rods 22 inserted through the guide slots 39, and with the openings 28 of a pair of actuator rods connected to each end 30 of the rotary valve 16 via the elongated rods 24 and securing means 26, the actuator rods 22 at each end 30 may be alternately moved or reciprocated, in the direction of arrow 56 (FIG. 5), to smoothly rotate the rotor 16 between the open and closed positions.

It is to be understood that the entire fill tube and valve assembly described herein is preferably formed of stainless steel or other materials which may be easily assembled together and sealed, in such a manner that there will be no galling and so as to be easily cleaned. The parts of the present invention are accurately formed with very close tolerances and assembled so that a minimum of seams or openings are formed where viscous food product, such as cheese or the like, could catch or stay. All of the components of the present invention are sized and dimensioned so as to be easily cleaned and assembled with accurate and tight fits, to provide the most efficient and sanitary fill tube and valve control mechanism possible.

In operation, viscous material is fed into each fill tube 12, through the aperture 40, and travels down the fill tubes until it reaches the passageways 41 at the top of spreader 14. If the actuator rods 22 have been reciprocated so as to close the rotor valve, as shown in FIG. 5, the viscous food product will remain in the fill tubes and passageways 41 (see FIG. 5). However, if the actuator rods have been operated to rotate the rotor valve 16 to the open position with the openings 18 aligned with the same size apertures 46 and 50, viscous food product will be fed from discharge opening 50 into a pouch, surrounding the spreader 14, until a predetermined amount, by weight or volume, is held in the pouch. A feed pump mechanism and the form, fill and seal packaging machine will then cycle so as to cut off flow of product, to seal the pouch, and then to cut off the just filled pouch. Another partially formed pouch may then be brought into position so as to be accurately filled by the double fill tube assembly and rotary valve mechanism of the present invention.

Accordingly, as should be apparent to those skilled in the art, the present invention provides considerable advantages in the control and feeding of viscous food matter, such as cheese or the like, into flexible plastic pouches in a sanitary manner. The double fill tube assembly of the present invention includes a rotary shut off valve means that swiftly and cleanly shuts off the flow of viscous fluid therethrough, without any wastage. Furthermore, since the rotary shut off valve of the present invention is operated by pairs of actuating rods secured to each end thereof, the rotary valve may be more accurately and precisely controlled to thereby more accurately fill pouches and precisely cut off the flow of viscous product to a filled pouch, thereby avoiding wastage and contamination.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than as specifically described herein.

What is claimed is:

1. A fill tube assembly for a form, fill and seal pouch packaging machine; comprising, in combination:

a pair of cylindrical fill tubes having upper ends and lower ends;

a plate means having a pair of apertures therein secured in the packaging machine and to the upper ends in alignment with the cylindrical fill tubes;

a forming spreader having an opening therein secured to the lower ends for forming a packaging film tube around said spreader;

a rotor means having a pair of passageways formed therein, sealing secured in the film forming spreader in alignment with the lower ends; and operating means, guided by the plate means, secured to the rotor means for moving the pair of passageways between open and closed positions.

2. The fill tube assembly of claim 1 wherein the rotor means has two ends, and the operating means is secured at the two ends of the rotor means.

3. The fill tube assembly of claim 2 wherein the rotor means is cylindrical and the two passageways formed therein are oval shaped.

4. The fill tube assembly of claim 3, further including a pair of shaped passageways formed in the film form spreader, between the fill tube lower ends and the rotor means.

5. The fill tube assembly of claim 4, further including a pair of oval-shaped outlet openings formed in the film forming spreader, downstream of the rotor means and away from the pair of shaped passageways in the film forming spreader.

6. The fill tube assembly of claim 5 wherein the plate means has two ends with a pair of slots formed at the two ends, and the operating means comprises two pair of actuator rods, with each pair of actuator rods extending through one of the pair of slots and secured to the two opposed ends of the rotor means.

7. The fill tube assembly of claim 1 wherein the operating means is comprised of a plurality of actuator rods extending through a plurality of slots formed through said plate means.

8. The fill tube assembly of claim 7 wherein the pair of passageways in the rotor means are oval shaped, and the film forming spreader includes a pair of matching, oval shaped opening formed therein above the rotor means, toward the pair of fill tubes, and below the rotor means, downstream of the pair of fill tubes.

9. The fill tube assembly of claim 8 wherein the rotor means is cylindrical and has two approved ends, and the plurality of actuator rods are secured to the two approved ends.

10. The fill tube assembly of claim 9 wherein the film forming spreader has a pair of shaped, internal passageways connecting the pair of fill tubes to the pair of matching, oval shaped openings above the rotor means.

11. A fill tube assembly for a form, fill and seal pouch packaging machine; comprising, in combination:

a pair of cylindrical fill tubes, having upper ends and lower ends;

a plate means having a pair of apertures therein sealing secured to the upper ends and in the packaging machine;

the plate means having two ends with guide means formed in each of the two ends;

a forming spreader secured to the lower ends for forming a packaging film tube around said spreader the film forming spreader having a pair of internal shaped passageways connected between the lower ends of the pair of fill tubes and a valve means having two ends, rotatably secured in the spreader; and operating means extending through the guide means and secured to the two ends of the valve means for partially rotating the valve means between open and closed positions.

12. The fill tube assembly of claim 11 wherein the valve means is a cylindrical rotor having a pair of elongated, oval passageways formed therethrough.

13. The fill tube assembly of claim 12 wherein the operating means comprises a plurality of actuator rods secured to separate locations on the two ends of the cylindrical rotor.

14. The fill tube assembly of claim 13 wherein the pair of shaped, internal passages in the film forming spreader, slope inwardly so as to end in oval shaped apertures which match, in size and shape, the elongated, oval passageways in the cylindrical rotor.

15. The fill tube assembly of claim 14 wherein the film forming spreader has a pair of elongated, oval shaped discharge openings formed in a lower surface thereof, downstream of the pair of cylindrical fill tubes and the cylindrical rotor.

16. The fill tube assembly of claim 15 wherein the guide means in the plate means is comprised of a pair of slots formed in each of the two ends thereof.

17. The fill tube assembly of claim 16, further including a pair of elongated securing means inserted in a pair of openings, extending between the two ends of the cylindrical rotor in openings formed in the plurality of actuator rods and secured to the plurality of actuator rods.

18. A fill tube assembly for a form, fill and seal pouch packaging machine, comprising, in combination:

a pair of stainless steel, seamless, annular fill tubes having upper ends for receiving viscous food product and lower ends for discharging the viscous food product;

a plate held in the form, fill and seal pouch packaging machine, the plate having a pair of apertures formed extending therethrough sealing secured to the upper ends;

the plate including two opposed ends with a pair of guide slots formed at each of the two opposed ends;

a forming spreader for spreading and maintaining front and rear sealable film utilized to form pouches around said spreader, sealing secured to the lower ends of the fill tubes;

the film forming spreader having a pair of passageways, a pair of discharge ports and a cylindrical opening formed therein;

an elongated, cylindrical valve member having two ends and two oval shaped passages formed therethrough, sealingly secured in the cylindrical opening; and a plurality of actuator rods extending through the pair of guide slots at each of the twp opposed ends of the plate and secured to the two ends of the elongated, cylindrical valve member by separate securing elements held in the cylindrical valve member, for partially rotating the elongated cylindrical valve member between an open position, aligned with the pair of passageways and the pair of discharge ports, and a closed position, out of alignmemt with the pair of passageways and the pair of discharge ports.

19. The fill tube assembly of claim 18 wherein the pair of stainless steel, seamless, annular fill tubes are approximately three inches in diameter with walls which are approximately 0.065 inches thick.

* * * * *